United States Patent [19]

Adolfsson et al.

[11] 4,342,710

[45] Aug. 3, 1982

[54] APPARATUS FOR AERATING BEVERAGES

[75] Inventors: Rune Adolfsson, Solna; Lennart Berns, Lund, both of Sweden

[73] Assignee: Intercylinder AB, Lund, Sweden

[21] Appl. No.: 243,421

[22] Filed: Mar. 13, 1981

[30] Foreign Application Priority Data

Mar. 20, 1980 [SE] Sweden ..... 8002181

[51] Int. Cl.[3] ..... B01F 3/04

[52] U.S. Cl. ..... 261/121 R; 99/275; 99/323.1; 261/DIG. 7; 426/477

[58] Field of Search .... 261/121 R, DIG. 7, DIG. 16, 261/DIG. 65, DIG. 14, DIG. 47; 99/275, 323.1; 426/474, 477

[56] References Cited

U.S. PATENT DOCUMENTS

| | | | |
|---|---|---|---|
| 1,546,510 | 7/1925 | Possner | 261/121 R X |
| 2,160,043 | 5/1939 | Threm | 261/DIG. 16 |
| 2,205,938 | 6/1940 | Ward | 426/477 X |
| 2,805,846 | 9/1957 | Dewan | 261/121 R |
| 3,953,550 | 4/1976 | Gilbey | 261/DIG. 7 |
| 4,251,473 | 2/1981 | Gilbey | 261/121 R X |

FOREIGN PATENT DOCUMENTS

| | | | |
|---|---|---|---|
| 81350 | 8/1934 | Sweden | 261/DIG. 7 |
| 189535 | 11/1922 | United Kingdom | 261/DIG. 7 |
| 1468469 | 3/1977 | United Kingdom | 261/DIG. 7 |

*Primary Examiner*—Richard L. Chiesa

*Attorney, Agent, or Firm*—LeBlanc, Nolan, Shur & Nies

[57] ABSTRACT

An apparatus for aerating for domestic use beverages, such as flavored water. The apparatus comprises a stand (2) with space assigned for a glass bottle (4) and with space assigned for a gas tube (4) containing carbon dioxide, and a sealing member (7) for sealing the mouth (8) of a glass bottle (4) during the aerating process.

According to the invention, at the place for the glass bottle (4) a bursting protection (15) is provided, which is movable upward and downward in relation to a glass bottle (4) positioned and to the stand (2), and which in its upper position permits free insertion and removal of a glass bottle (4), and in its lower position encloses entirely a glass bottle (4) thus positioned. The sealing member (7) is located in the upper portion of the bursting protection (15) and capable to seal against the mouth (8) of a glass bottle (4) only when the bursting protection (15) is in its lower position. Hereby a safe and easily handled apparatus is obtained.

5 Claims, 4 Drawing Figures

APPARATUS FOR AERATING BEVERAGES

Figure 1:
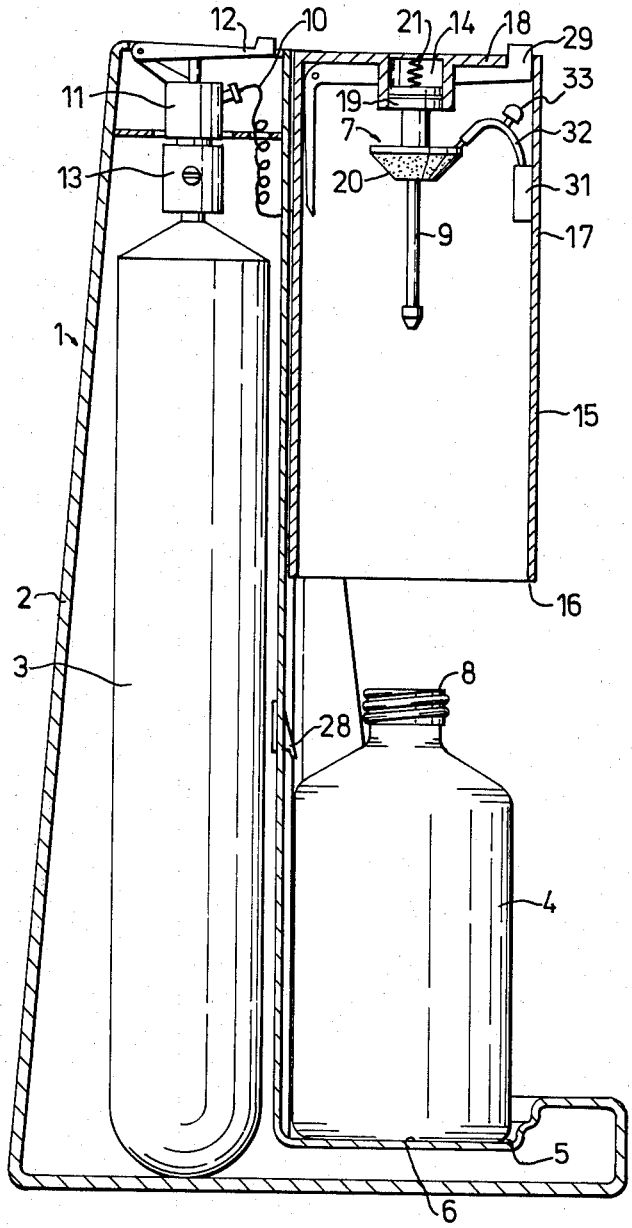

This invention relates to an apparatus for aerating a liquid, such as water and flavoured water, for preparing aerated beverages. Several apparatuses to be used for this purpose are previously known, all of which comprise a stand and a sealing member for sealing the mouth of a glass bottle during the aeration process. Carbon dioxide is supplied to the interior of the bottle through a pipe extending through the sealing member and aerates the content in the bottle.

At one such known apparatus, which is disclosed in GB-PS 1 468 469, a sealing member comprising a rubber cone movable against the pressure from a spring is positioned in the upper portion of a cylinder, which is hingedly attached in the stand at its upper portion. The cylinder constitutes a protection against bursting. The glass bottle is inserted from below into the cylinder, in that the cylinder is swung outward so that its lower end is located outside the stand. Thereafter the cylinder is swung inward to the stand to a substantially vertical position whereafter the bottle is pressed against the resilient sealing member due to co-operation of the bottle with a supporting surface on the stand.

The protection against bursting is extremely important, because glass bottles having been used and re-used may be damaged or have material defects, which may cause the bottle to burst to pieces at the aerating process, which takes place at a relatively high pressure.

This known apparatus, however, has the disadvantage that, when the high pressure in the bottle during the aerating process has not been vented sufficiently, the bottle at the outward pivotal movement of the cylinder for removing the bottle will be pushed out of the cylinder with great force and may injure the operator.

A serious risk involved with the known apparatus in this connection is, that children handling the apparatus at home may pivot the cylinder outward when the bottle is under pressure, whereby the bottle is ejected from the cylinder with very great force.

A further disadvantage is, that it is relatively difficult to insert the bottle, because the mouth of the bottle must be fitted against the sealing member, which is not visible at the moment of insertion. The bottle, moreover, may easily be dropped when it is to be removed from the cylinder.

The present invention eliminated entirely the aforesaid disadvantages. The present invention, thus, relates to an apparatus for aerating beverages, such as water and flavoured water, for domestic use. The apparatus comprises a stand, in which space is assigned for a glass bottle and for a gas tube containing carbon dioxide, and a sealing member for sealing the mouth of a glass bottle during the aeration process, through which sealing member a pipe for carbon dioxide extends and opens beneath the sealing member.

The invention is characterized in that at the space assigned for the glass bottle a bursting protection is provided, which is movable upward and downward relative to the stand and to a glass bottle positioned as intended, which bursting protection in its upper position permits free placement of a bottle standing in a place assigned for this purpose in the lower portion of the stand, and which in its lower position entirely encloses a bottle thus positioned, and that said sealing member is located in the upper portion of the bursting protection and capable to be caused to seal against the mouth of a bottle only when the bursting protection is in its lower position.

Figure 2:
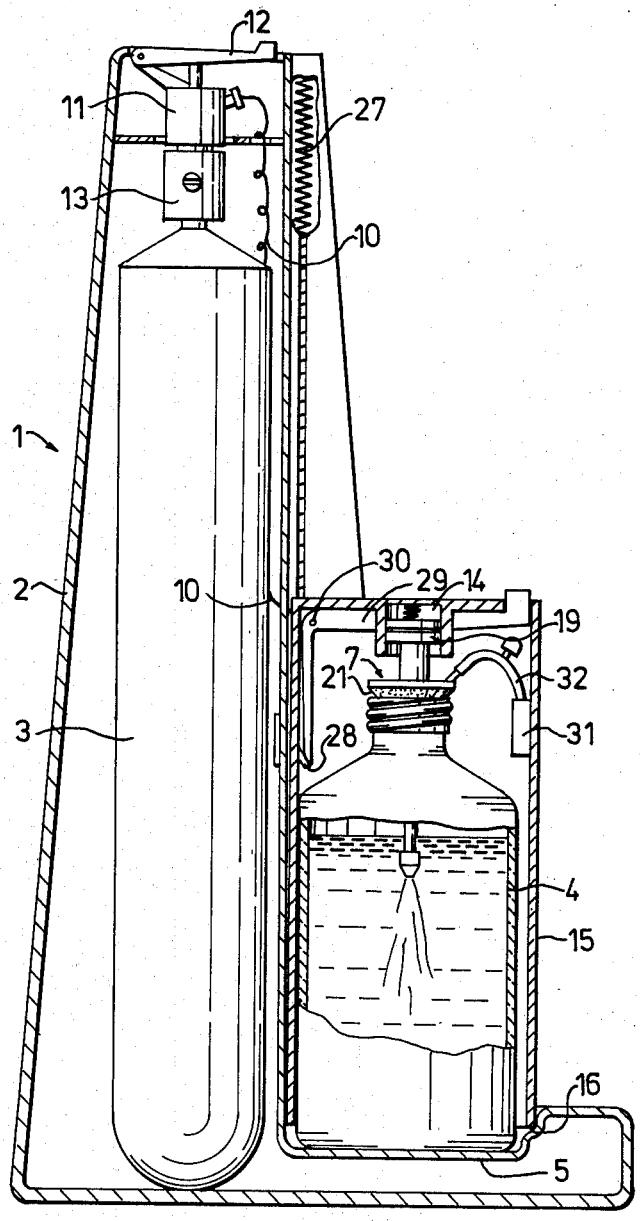
Figure 3:
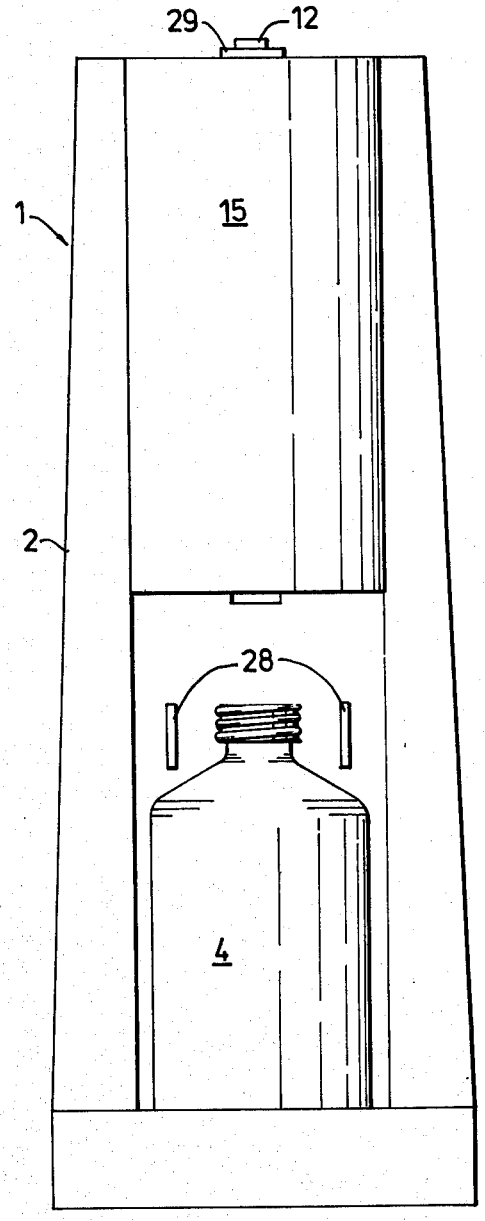
Figure 4:
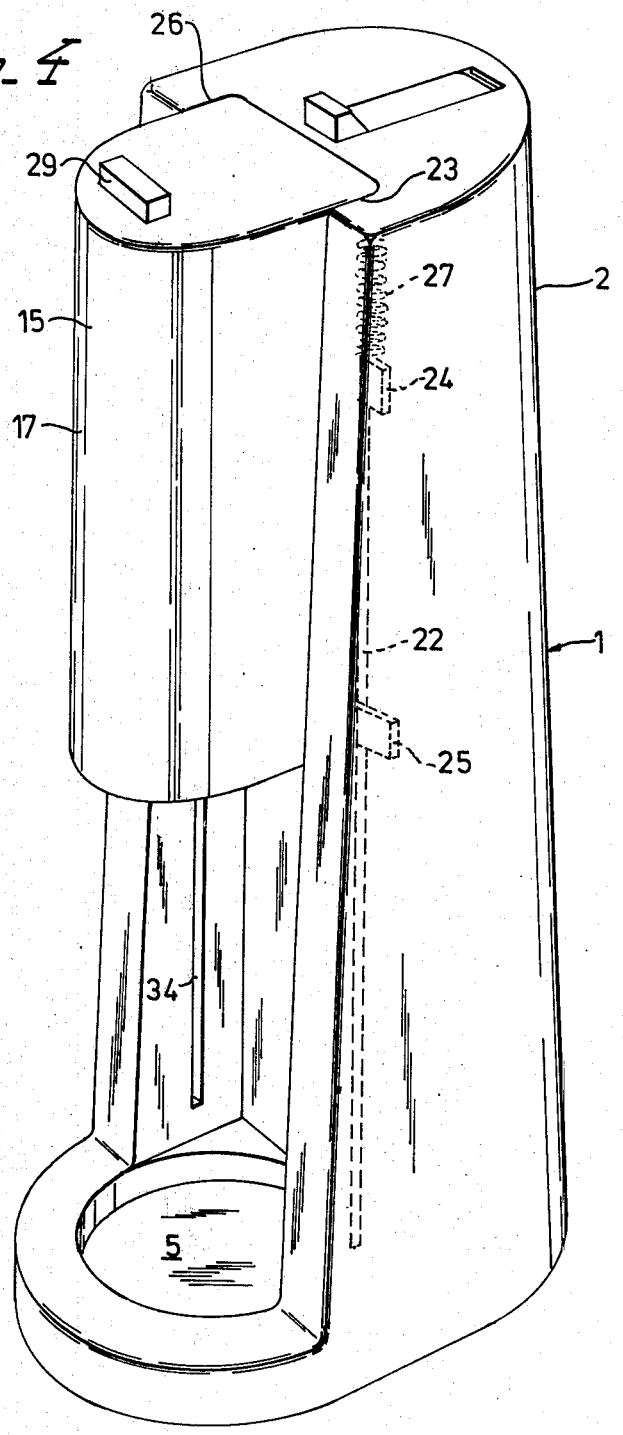

The invention is described in greater detail in the following, with reference to the accompanying drawings, in which FIG. 1 is a section through the apparatus, in which the bursting protection is in its upper position, FIG. 2 is a section corresponding to the one shown in FIG. 1, where the bursting protection is in its lower position, FIG. 3 is a view of the apparatus seen from the right in FIG. 1, and FIG. 4 is a perspective view of the apparatus.

In FIG. 1 a section through an apparatus 1 for aerating beverages is shown, which comprises a stand 2, which is of plastic or metal material and includes space for a gas tube 3 containing carbon dioxide.

In the lower portion of the stand 2 space is assigned for a glass bottle 4, which contains the liquid to be aerated. The stand 2 is provided with a sunk portion 5, on the plane bottom 6 on which such a glass bottle is to be positioned. Said sunk portion 5 is circular as shown in FIG. 4 and thereby renders it possible that a glass bottle placed there is positioned accurately relative to the stand 2.

The apparatus further comprises a sealing member 7 for sealing the mouth 8 of a glass bottle 4 while the aeration process is going on. A pipe 9 extends through the sealing member 7 and opens beneath the same. Its mouth is intended to be located at the aeration process below the liquid level in the glass bottle 4. The pipe 9 communicates by a hose 10 via a valve means 11 with the gas tube 3. The valve means 11 are adapted upon pressure applied to an arm 12 to actuate a pin in a valve 13 associated with the glass tube 3, thereby carbon dioxide flows out at high pressure, for example 40 bar, through the hose 10 to a cylindric space 14, which is described below in greater detail.

At the place 5 for the glass bottle 4 a bursting protection 15 is provided, which is movable upward and downward relative to the stand 1 and to a glass bottle 4 positioned in the way intended, and which in its upper position shown in FIG. 1 permits free placement of a bottle 4 standing in the place 5 assigned for this purpose, and which in its lower position shown in FIG. 2 entirely encloses a glass bottle 4 positioned in this way.

When the bursting protection 15 is in its lower position, its lower end 16 is in the aforesaid sunk portion 5 in the stand 2, whereby a bottle 4 is enclosed entirely by the bursting protection 15.

The bursting protection comprises an outer casing 17, the shape of which is apparent from FIG. 4, and preferably an inner casing, which is cylindric and has a diameter slightly exceeding the outer diameter of a glass bottle. Said casings are attached one to the other.

The sealing member 7 according to the invention is located in the upper portion 18 of the movable bursting protection 15 and capable to be caused to seal against the mouth 8 of a bottle 4 only when the bursting protection 15 has been moved to its lower position, as shown in FIG. 2.

The sealing member 7 comprises a cylinder 14 as mentioned above, which is formed in the upper portion 18 of the bursting protection 15. Said cylinder 14 is directed downward and open to the lower end 16 of the bursting protection. In said cylinder 14 a piston 19 is located, which carries a rubber cone 20, through which the pipe 9 extends. The piston 19 is movable in the cylinder 14, in which it is attached, and is carried by a compression spring 21.

The cylindric space formed between the bottom of the cylinder 14 and the piston 19 communicates, as mentioned, with the gas tube 3 via valves, whereby the cylindric space is supplied with primary pressure from the gas tube when the valve 13 of the gas tube is operated to open. Through a hole (not shown) in the piston 19 the pipe 9 communicates with the cylindric space.

The bursting protection 15 is adapted to be attached to the stand and in a suitable way to run in grooves or the like in the stand. Such an embodiment is shown in FIG. 4. A groove 22 in the short wall 23 of the stand 2, against which groove the bursting protection 15 is arranged to slide, and projections 24,25 from the bursting protection 15 which run in said groove are indicated by dashed lines. A corresponding groove 34 and corresponding projections are provided on the opposite side of the bursting protection, i.e. in the short wall 26.

In FIG. 4 also a tension spring 27 is indicated, which is attached between the upper surface of the stand and the projection 24 and intended to maintain the bursting protection in its upper position.

When the bursting protection is being removed downward to its lower position against the action of the spring 27, a resilient tongue 28 is arranged to co-operate with openings in the rear wall of the bursting protection 15, as shown in FIG. 2, and thereby to maintain the bursting protection in its lower position. The tongues 28 can be pressed inward by the arm 29, which is pivotal about the point 30, whereby the bursting protection is released and slides upward to its upper position by action of the spring 27.

The pipe 9 communicates, besides with the cylinder 14, with a pressure relief valve 31 via a hose 32. On said hose 32 preferably a safety valve 33 is provided which is intended to open at a definite pressure, preferably 15 to 20 bar. The pressure relief valve 31 is intended to open at a lower pressure, preferably 10 to 12 bar, which is achieved when the liquid in the glass bottle is aerated.

The mode of operation of the apparatus is described briefly in the following.

A glass bottle 4 is positioned in its intended place 5. Thereafter the bursting protection 15 is moved down to its lower position and maintained there by the tongue 28. First in this position the sealing member 7 contacts the mouth 8 of the bottle 4. The compression spring 21 takes up dimensional tolerances with respect to the height of the glass bottle and the diameters of the mouth 8 and, respectively, rubber cone 20. The compression spring 21, thus, brings about an initial sealing between the rubber cone 20 and the mouth 8. Thereafter the valve 13 of the gas tube 3 is opened by the arm 12 and carbon dioxide at high pressure flows into the cylinder 14 and down through the pipe 9. The primary pressure acts on the area of the piston 19 which is greater than the area of the mouth 8, whereby the pressure of the rubber cone against the bottle increases.

Upon continuing aeration the gas pressure in the bottle increases. When the pressure is 10 to 12 bar, the pressure relief valve opens and emits a certain sound, which informs the operator on that the aeration is completed. Thereafter the valve 13 is closed by the arm 12. Hereby the high pressure against the piston 19 ceases, which causes the sealing to deteriorate, so that the pressure in the bottle drops substantially below the previous pressure and possibly is balanced entirely with the atmospheric pressure. Thereafter the arm 29 is depressed, whereby the bursting protection is returned to its upper position.

As appears from the aforesaid, the bursting protection 15 is very efficient, in that it encloses entirely the bottle 4, and its lower edge 16 at the aeration process is within the sunk portion 5. Aeration can take place only when the bursting protection 15 is in its lower position, because the sealing member 7 is located in the upper portion of the bursting protection 15.

This implies that, irrespective of how the apparatus is being handled, pressure in the bottle 4 cannot have the effect that the bottle is ejected forcefully in any direction and may injure the operator.

Furthermore, as has become evident, insertion and removal of the bottle is carried out in a very comfortable and simple way.

The present invention, thus, offers considerable advantages with respect to safety and handling, and it entirely eliminates the aforesaid problems of known apparatuses.

The bursting protection 15 can be attached to and run in the stand 2 in another suitable way, for example by dovetail slot or the like. The sealing member 7, further, may in principle consist of other sealing means, which initially can be moved through a distance for taking up variations in the dimensions of the glass bottles.

The invention, thus, must not be regarded restricted to the embodiment described above by way of example, but can be varied within the scope of the attached claims.

We claim:

1. An apparatus for aerating for domestic use beverages, such as water and flavoured water, comprising a stand (2) with space assigned for a glass bottle (4) and with space assigned for a gas tube (b) which contains carbon dioxide, and a sealing member (7) for sealing the mouth (8) of the glass bottle during the aerating process, through which sealing member (7) a pipe (9) for carbon dioxide extends and opens beneath the sealing member, and controllable fluid communication means connected to said pipe and adapted to be connected to the gas tube to enable controlled flow of carbon dioxide to and through said pipe, characterized in that at the place assigned for the glass bottle a bursting protection is provided, which is movable upward and downward in relation to the stand and to the glass bottle positioned in the way intended, and which in its upper position permits free placement of the bottle standing in the place assigned for this purpose in the lower portion of the stand, and in its lower position entirely encloses the bottle thus positioned, and that said sealing member is located in the upper portion of the bursting protection and capable to be caused to seal against the mouth of the bottle only when the bursting protection is in its lower position.

2. An apparatus as defined in claim 1, characterized in that the bursting protection (15) is closed except at its lower end, and that the lower end (18) of the bursting protection (15), when the bursting protection is in its lower position, is located in a sunk portion (5) in the stand (2), in which portion (5) the glass bottle (4) is intended to stand on its bottom.

3. An apparatus as defined in claim 1 or 2, characterized in that the bursting protection (15) comprises an outer casing (17) and an inner casing attached inside said outer casing, which inner casing is cylindric and has an inner diameter slightly exceeding the outer diameter of the bottle (4) intended for use.

4. An apparatus as defined in claim 1 or 2, characterized in that the sealing member in the upper portion of the bursting protection (15) comprises a cylinder (14), which is formed in the bursting protection and directed and open to the lower end (16) of the bursting protection (15), in which cylinder a piston (19), which carries a rubber cone (20) with said pipe (9) extending therethrough, is movable and attached to the bottom of the cylinder (14) by means of a compression spring (21).

5. An apparatus as defined in claim 4, characterized in that a cylindric space formed between the bottom of the cylinder (14) and the piston (19) is intended to be supplied with primary pressure from said gas tube (3) by means of a hose (10), whereby the piston (19) forcefully presses the rubber cone (20) against the mouth (8) of the bottle (4) when the bursting protection (15) is in its lower position.

* * * * *

UNITED STATES PATENT AND TRADEMARK OFFICE

CERTIFICATE OF CORRECTION

PATENT NO. : 4,342,710

DATED : August 3, 1982

INVENTOR(S) : Rune Adolfsson, Lennart Berns

It is certified that error appears in the above—identified patent and that said Letters Patent is hereby corrected as shown below:

In the Abstract, line 4 change "gas tube (4) change "gas tube (4) to --gas tube (3)--.

Column 2, line 35, change "thereby" to --whereby--.

Column 2, line 35, change "glass" to-gas--.

In the claims:

Claim 1, line 4, change "(b)" to --(3)--.

Signed and Sealed this

Ninth Day of November 1982

[SEAL]

*Attest:*

GERALD J. MOSSINGHOFF

*Attesting Officer*

*Commissioner of Patents and Trademarks*